United States Patent [19]

Henricson et al.

[11] Patent Number: 4,619,736

[45] Date of Patent: Oct. 28, 1986

[54] APPARATUS FOR DEFIBERIZING, SCREENING AND PUMPING CELLULOSE PULP OR RECYCLED PAPER

[75] Inventors: Kaj O. Henricson, Kotka; Pekka O. Peltola, Anjala, both of Finland

[73] Assignee: A. Ahlstrom Osakeyhtio, Noormarkku, Finland

[21] Appl. No.: 627,415

[22] Filed: Jul. 3, 1984

[30] Foreign Application Priority Data

Jul. 12, 1983 [FI] Finland ..... 832531

[51] Int. Cl.[4] ..... D21B 1/32

[52] U.S. Cl. ..... 162/261; 162/4; 162/28; 241/46.11; 241/74; 415/121 B; 415/121 G

[58] Field of Search ..... 162/4, 28, 55, 58, 191, 162/201, 261; 415/121 B, 121 G; 241/46.06, 46.11, 46.17, 74, 89.3, 96

[56] References Cited

U.S. PATENT DOCUMENTS

| | | | |
|---|---|---|---|
| 3,627,280 | 12/1971 | Fridman et al. | 415/121 B |
| 3,960,332 | 6/1976 | Seifert | 241/46.06 |
| 4,435,122 | 3/1984 | Niskanen et al. | 415/121 B |
| 4,435,193 | 3/1984 | Gullichsen et al. | 162/55 |
| 4,460,132 | 7/1984 | Thumm et al. | 162/261 |

FOREIGN PATENT DOCUMENTS

| | | | |
|---|---|---|---|
| 2411043 | 9/1975 | Fed. Rep. of Germany | 415/121 B |
| 2518179 | 11/1976 | Fed. Rep. of Germany | 415/121 G |
| 197804 | 4/1978 | France | 241/74 |
| 0663770 | 5/1979 | U.S.S.R. | 162/55 |

OTHER PUBLICATIONS

*Wochenblatt fur Papierfabrikation*, 1980, pp. 747–748.

*Primary Examiner*—S. Leon Bashore
*Assistant Examiner*—Andrew J. Anderson
*Attorney, Agent, or Firm*—Bucknam and Archer

[57] ABSTRACT

Cellulose pulp or recycled paper is defiberized, screened and pumped. Initial defiberizing, separation of non-disintegrated material, final defiberizing and pumping of the defiberized pulp are performed at a consistency of 6 to 18%, preferably 8 to 12%. Preferably all operations are performed at the same consistency. A defiberizing rotor is disposed in front of an impeller in the inlet of a centrifugal pump. A screen plate is mounted close to the defiberizing rotor. Defiberizing elements are arranged on the other side of the screen plate to move close to the screen surface.

10 Claims, 5 Drawing Figures

APPARATUS FOR DEFIBERIZING, SCREENING AND PUMPING CELLULOSE PULP OR RECYCLED PAPER

BACKGROUND OF THE INVENTION

The present invention relates to a method and an apparatus for defiberizing, screening and pumping pulp, particularly intended for pulps of high (i.e. 6 to 18%) consistency. The invention is, however, applicable also in the consistency range of 1 to 6%.

PRIOR ART

Cellulose or recycled paper can be defiberized, for example, in a pulper, or in a rotating drum system as presented in Canadian Pat. No. 1078557. The pulper consists of a vessel where the suction created by a rotor causes the material to flow towards the jacket, where the rotor blades shred the paper material into small pieces. The speed difference between the material flowing from the rotor and the surrounding material causes the paper pieces to be subjected to friction forces which disintegrate the fibres. Defiberization is carried out at a consistency of 2 to 3%, and, in order to avoid unreasonably high power consumption, the final defiberization is carried out in a separate defiberizer.

In the drum system, waste paper is defiberized in a rotating drum having a perforated jacket and longitudinal internal lifting ribs. When the wetted paper falls from a level above the center axis to the lowest part of the drum jacket, the fibre bonds are disrupted and the detached fibres and fibre clusters are drained off with the defibration liquid through the perforations in the jacket to a tank positioned below the drum. After the treatment, the maximum size of the paper pieces is 6 mm and the consistency of the pulp is 3 to 5%.

Defiberizing waste paper at a high consistency (10 to 18%) in a cone breaker has been proved possible, as disclosed, for example, in Wochenblatt für Papierfabrikation 1980, pp. 747 to 748. In this method a relatively large screw rotor generates a rotating motion in the pulper. The speed differences between the flowing suspension layers bring about friction forces which defiberizes the cellulose sheets or paper pieces and detach the fibres from each other. After defibration, the pulp is diluted to a pumpable consistency (1 to 6%) and is discharged from the pulper. In order to keep the defiberizing time reasonably short, the final defiberizing is in general carried out in a separate defiberizer, or in a secondary pulper into which the pulp is pumped from the pulper discharge tank.

A pulper can be discharged at a pulp consistency of 6% by a special pump designed for that purpose. A conventional centrifugal pump cannot be used for pumping pulp having a consistency over 6% as, due to flocculation of the pulp, the pump will be clogged. U.S. Pat. No. 4,435,122 discloses an apparatus for treatment of high consistency (>6%) fibre suspensions. In this method, the fibre suspension is subjected in front of an impeller to shear forces which disrupt the fibre bonds whereby the suspension is fluidized and converted into an easily pumpable state. The fluidization is caused, for example, by recesses or protrusions in the inner surface of the inlet part and by the non-circular configuration of the rotor.

The final defibration, which in general is carried out in a separate defibrator, can also be performed in the inlet of the pump by generating strong shear forces in this area, as disclosed in U.S. patent application Ser. No. 551,870, filed Nov. 15, 1983, now abandoned. The defiberizing effect is achieved, for example, by ribs of special shape disposed on the rotor and in the inner surfaces of the apparatus, bringing about intensive local turbulence fields, or being positioned so close to each other that a grinding effect is achieved. The method is applicable in the consistency range of from 1 to 15%. In the treatment of high consistency (>6%) pulps a rotor disposed in front of an impeller not only defiberizes but also fluidizes the pulp which is essential for the operation of the pump.

SUMMARY OF THE INVENTION

The present invention relates to a method of defiberizing cellulose, other pulps, or recycled paper, at a high consistency, carrying out the final defiberizing at a high consistency and pumping the pulp from the pulper at a high consistency. The invention also relates to an apparatus for carrying out the above operations continuously.

It is a characteristic feature of the method according to the invention that the initial defiberizing, the separation of non-disintegrated material and paper, the final defiberizing and the pumping of the defiberized pulp are carried out at a consistency of 6 to 18%, preferably 8 to 12%. Preferably, all operations are performed at the same consistency.

It is a characteristic feature of the apparatus according to the invention that it comprises a screen plate disposed close to the defiberizing rotor and defiberizing elements on the other side of the screen plate moving close to the screen surface.

FIG. 1 discloses a pulper known in the art, which operates at a high consistency. When the pulp is adequately defiberized, normally in 5 to 20 minutes, it is discharged from the pulper. Discharging is carried out by opening the sluice valve and diluting the pulp to a pumpable consistency. The pulp falls into a pump wherefrom it is pumped into a tank. Loading and discharging the pulper takes approximately 3 to 5 min. Normally, approximately one third of the time is taken by the discharging and loading operations. By changing the construction of the discharge pipe and by using a pump designed for high consistencies, the pulper can, at least at the beginning, be discharged at a high consistency, but dilution is probably still needed for discharging the rest of the pulp.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENTS

Figure 1:
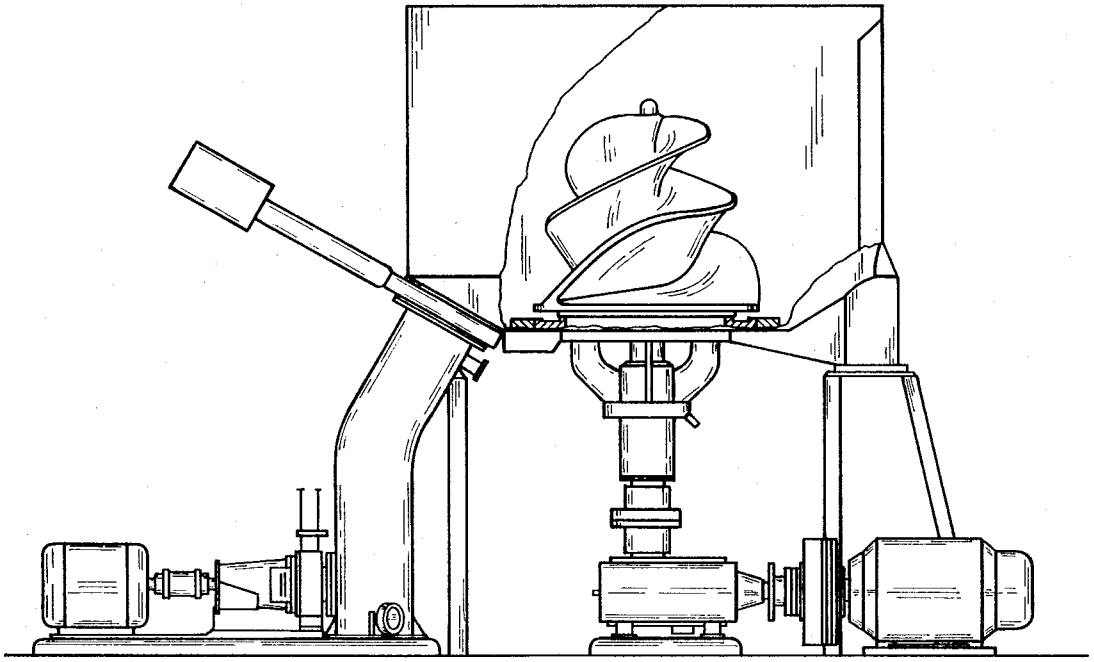
FIG. 1 PRIOR ART
FIG. 1 is a partial vertical section of an embodiment of a pulper of the prior art.
Figure 2:
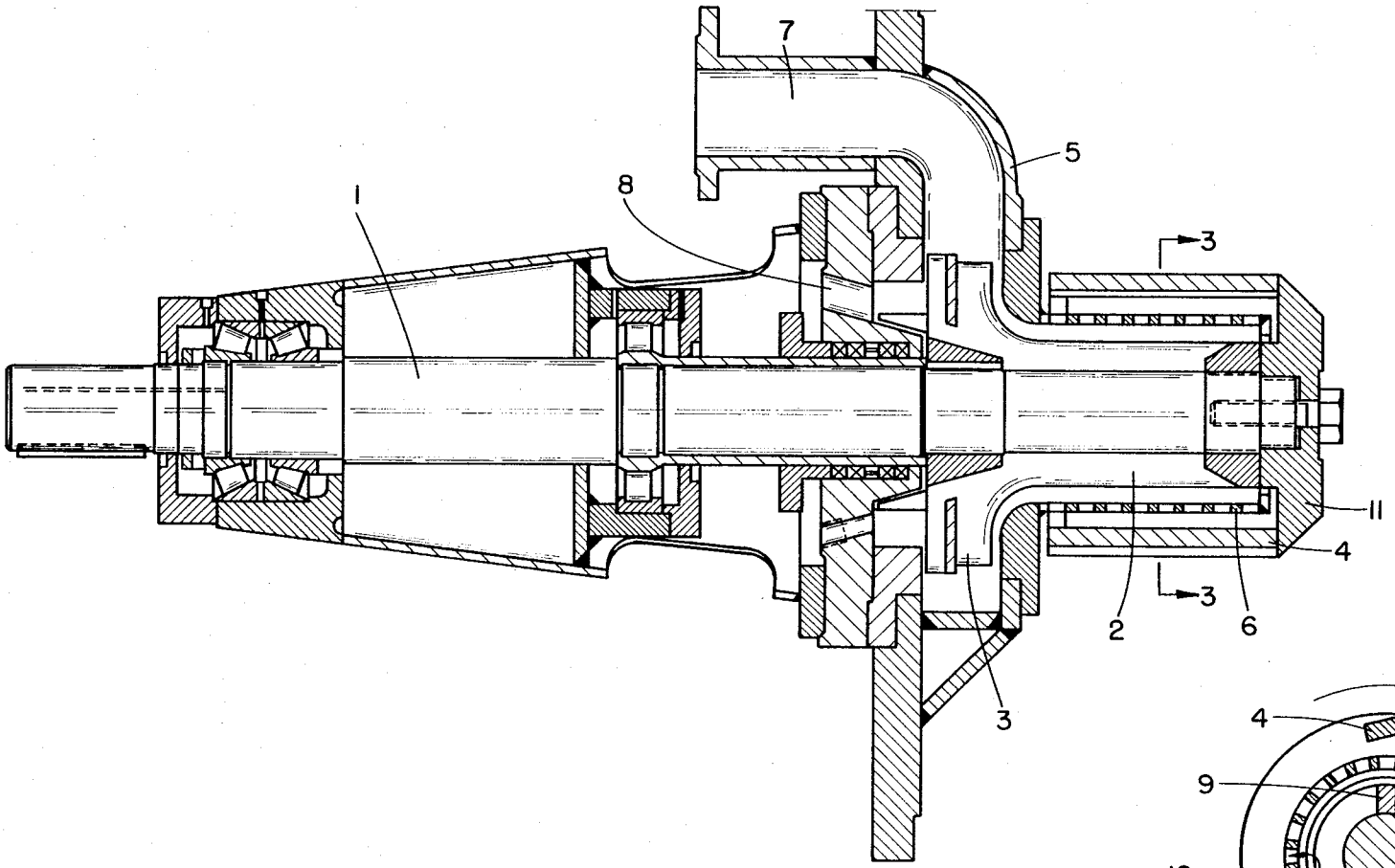
FIG. 2 is a longitudinal section of an embodiment of defiberizing, screening and pumping apparatus of the invention.
Figure 3:
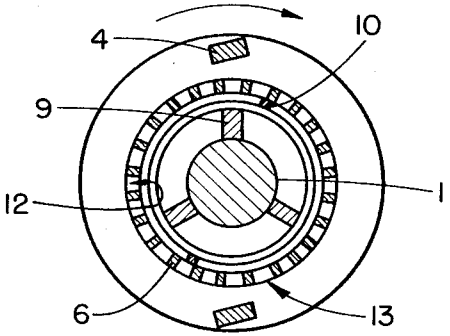
FIG. 3 is a section, taken along lines A—A in FIG. 2.

The principal components of the apparatus illustrated in FIGS. 2 and 3 are a shaft 1 which is rotatably journalled. A defiberizing rotor 2 is affixed to the shaft. An impeller 3, defiberizing elements 4 and a pump housing 5 are provided. A screen drum 6 is fixed in the pump housing 5 and said housing is provided with a discharge pipe 7 for pulp and an exhaust orifice 8 for air. The interior surface of which the screen drum 6 is provided with sharp-edged ribs 10. The screen drum 6 surrounds vanes 9 of the defiberizing rotor 2. An end wall 11 is mounted at the end of the shaft 1.

The shaft 1 is used to rotate the impeller 3 and the machine elements 2 and 4, which defiberize paper or cellulose. The rotating speed is normally 1500 to 5000 rpm, depending on the size of the apparatus. In high consistency pumping, the separated air is removed through the air exhaust orifice 8. The defiberizing rotor 2 performs the final defiberizing of the pretreated pulp. In view of the controllability of the process, the defiberizing effect of the defiberizing rotor should be regulable, as presented in U.S. patent application Ser. No. 551,870, filed Nov. 15, 1983, in the name of Kaj Olof Henricson, now abandoned. The distance between the defiberizing rotor vanes 9 and the screen drum ribs 10 or the inside surface 12 of said drum is in the range of 2 to 30 mm, depending on the pulp grade. The screen drum 6 prevents large cellulose or paper pieces, metal wires and other scrap from getting into the defiberizing rotor 2. This is necessary, since non-disintegrated material can damage the interior of the apparatus and disturb its operation. Large paper pieces are not properly defiberized in the defiberizing rotor 2 during the short treatment time. The screen drum 6 is preferably provided with the ribs or counter blades 10, although this is not always necessary. The diameter of the perforations in the screen drum 6 varies according to the pulp to be treated, and is normally from 10 to 30 mm.

It is advisable to select a number of ribs 10 inside the screen drum 6 different from the number of defiberizing rotor vanes 9. Also the external defiberizing elements 4 keep the screen surface 13 clean. The defiberizing elements 4 preferably push the pulp towards the screen surface 13 while the distance between the elements and said screen surface is in the range of 20 to 80 mm. This may be accomplished by the positioning of the defiberizing elements 4 relative to the screen surface 13.

The rotating end wall 11 may be provided with vanes. The end wall, the vanes and the external defiberizing elements 4 form a system by which the pulp is kept moving close to the apparatus and in the pulper itself. The size and form of these devices can vary depending on the purpose for which the pulper is used.

Figure 4:
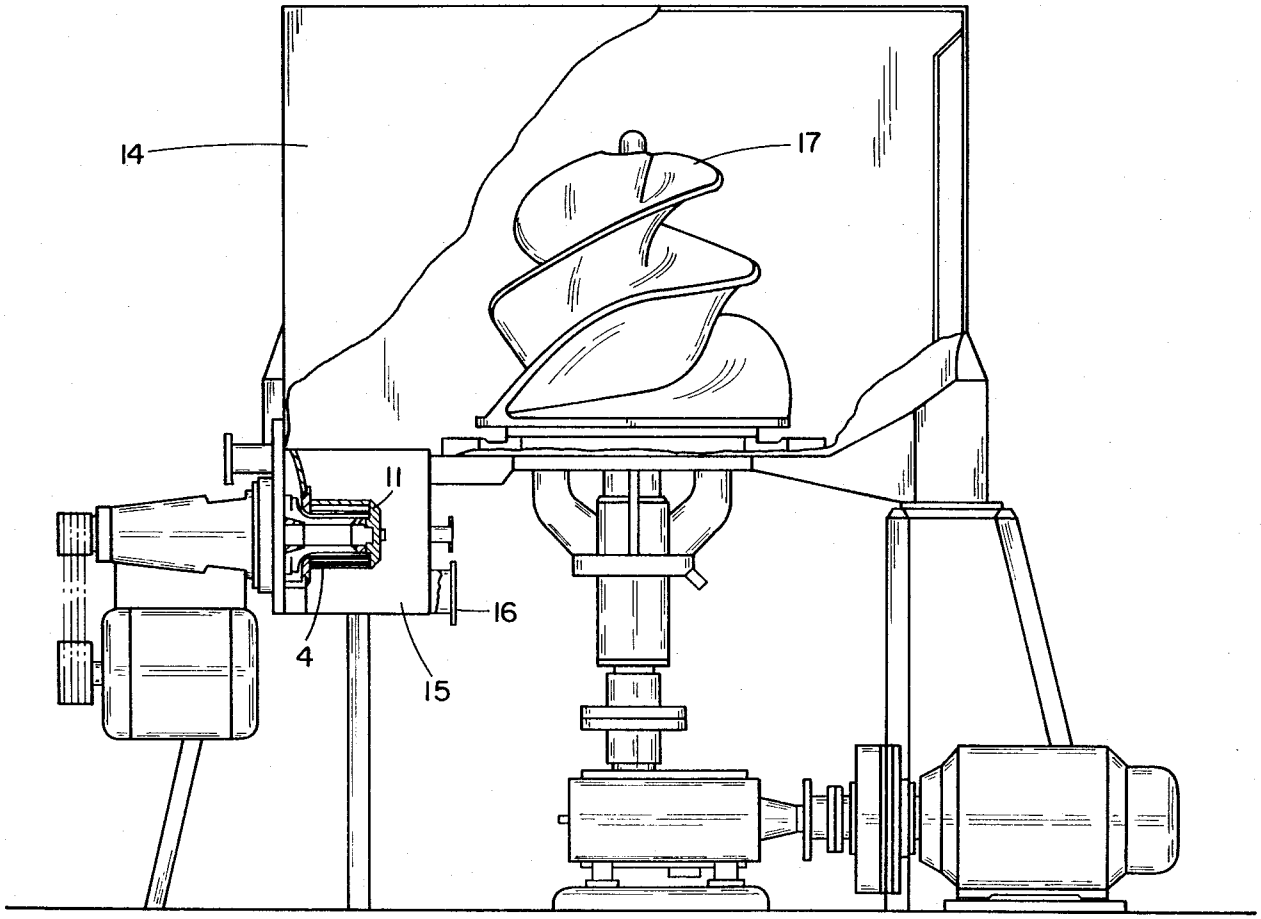
FIG. 4 is a partial vertical section of an embodiment of apparatus for carrying out the method of the invention.

FIG. 4 illustrates how the apparatus of FIG. 2 is placed in a pulper. Room for scrap and other non-disintegrated material is provided under the apparatus. This scrap can be removed in batches through an orifice 16, although the pulper otherwise operates continuously. In normal cases, the apparatus of the invention is attached to a pulper provided with a cone breaker 17, for example. Some paper grades permit some pulpers to achieve adequate initial defibration via the external defiberizing elements 4 and the end wall 11 provided with vanes.

Usually, all the water required in the pulper is supplied with the pulp to the tank. If the screen 6 has to be cleaned, it may be necessary to use water for washing which dilutes the pulp between the tank and the pump. The consistency in the tank may then be 15 to 18% and that in the pump approximately 8 to 12%. Dilution of this kind may also be necessary for the operation of the pump. It has been proven that some pulps are difficult to pump at a consistency greater than 12 to 14%.

Figure 5:
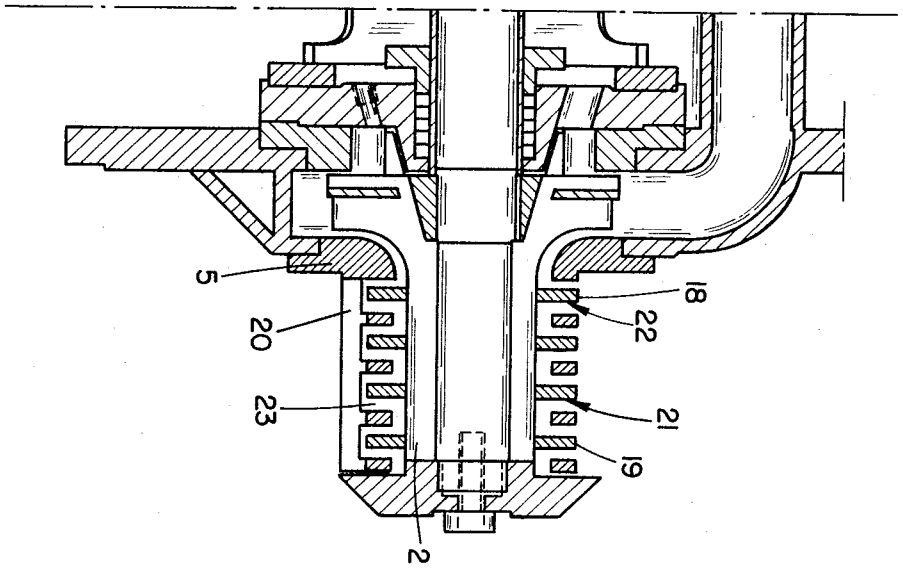
FIG. 5 is a longitudinal section of another embodiment of the defiberizing, screening and pumping apparatus of the invention.

In the embodiment of the invention illustrated in FIG. 5, the screen member comprises stationary rings 18 and rotating discs 19. The discs 19 are affixed to the rotor 2. The rings 18 are connected to each other and affixed to the pump housing 5 through bars 20. The side surfaces 21 of the rotating discs 19 and the side surfaces 22 of the stationary rings 18 form narrow slots 23 which function as screening slots and are kept open by said the rotating discs. The rotating discs 19 may have protrusions or recesses, or they can be replaced by pins disposed in the defiberizing rotor 2.

The advantages of the apparatus of the invention compared with conventional devices are obvious. The apparatus of the invention can be used for initial defibration, final defibration and pumping of pulp or recycled paper at a high consistency and for separating non-defiberized pulp or paper without intermediate dilution. This is significant particularly in paper machine reject circulation where broke can be returned straight to high consistency pulp towers. The method of the invention can be applied in a pulper operating continuously in the consistency range of 1 to 18%.

EXAMPLE

An example is assumed to be a broke pulper of a cellulose drying machine. The production of the machine is 1000 t/24 h and the width is 6 m. The required defiberizing time in a pulper is approximately 5 min. At the defiberizing consistency of 10%, the pulper volume is $$V=10m^3/t\times 1000/24t/h\times 5/60h=35m^3.$$

At the conventional consistency of 4%, the pulper volume is $$V=25m^3/t\times 1000/24t/h\times 5/60h=85m^3.$$

The machine width is approximately 6 m and the pulper height is 3 m, at the most. At the consistency of 10%, the pulper width in the machine direction is 2 m. At the consistency of 4%, the pulper width in the machine direction is 5 m.

High defiberizing consistency thus considerably reduces the size of the pulper. At the same time, the energy consumption of the pulper decreases, since the power required by the pulper depends partly on the amount of the pulp to be defiberized and partly on the amount of the liquid moving in the pulper. FIG. 4 illustrates schematically a high consistency machine pulper.

When a conventional 4% pulper is used, the defiberized broke is transported to a broke storage tank. Broke cannot be returned to a 10% consistency pulp tower from which fresh pulp has been brought to the drying machine, since the storage volume of the pulp increases when the consistency drops from 10% to 4%.

High defiberizing consistency dispenses with the need for a broke storage tank. After defibration, the pulp has the same consistency and requires the same storage volume as fresh pulp. Broke can thus be returned to the high consistency pulp tower.

The method of the invention thus provides considerable investment savings. The energy consumption in the pulper itself is reduced, but also the amount of energy used in pumping decreases as smaller water volumes are to be pumped.

The invention is not limited to the embodiment presented as an example, only, but may be modified within the scope of protection defined by the patent claims. The screen plate 6 and the defiberizing rotor 2 may be conical, for example. The vanes 9 of the defiberizing rotor 2 and the ribs of the screen plate 6 may be spiral and form an angle with each other. Also, the screen surface 13 may be provided with protrusions.

We claim:

1. Apparatus for defiberizing, screening and pumping pulp or recycled paper, at a determined high consistency which comprises a centrifugal pump having an inlet, an impeller and a defiberizing rotor disposed in said inlet in front of said impeller, a screen member comprising a screen plate surrounding and disposed in front of the defiberizing rotor in the flow direction of the pulp for separating nondisintegrated material;

and defiberizing elements on the opposite side of said screen member from said defiberizing rotor for initially defiberizing said pulp or paper at said determined high consistency.

2. Apparatus as claimed in claim 1, further comprising protrusions on the surface of said screen member.

3. Apparatus as claimed in claim 2, wherein said protrusions are on the surface of said screen member opposite that facing said defiberizing rotor.

4. Apparatus as claimed in claim 3, further comprising ribs having cutting edges and forming said protrusions.

5. Apparatus as claimed in claim 1, wherein said screen member comprises a cylindrical screen plate surrounding said defiberizing rotor.

6. Apparatus as claimed in claim 1, wherein said defiberizing rotor has a shaft and said defiberizing elements are affixed to said shaft of said defiberizing rotor.

7. Apparatus as claimed in claim 6, wherein said defiberizing elements are positioned so that they create a force directed towards the surface of said screen member when they rotate.

8. Apparatus as claimed in claim 6, wherein said defiberizing elements consist of profile bars disposed substantially in the direction of the shaft.

9. Apparatus for defiberizing, screening and pumping pulp or recycled paper, at a determined high consistency, said apparatus comprising a centrifugal pump having an inlet, an impeller and a defiberizing rotor disposed in said inlet in front of said impeller and a screen member surrounding and disposed in front of the defiberizing rotor in the flow direction of the pulp for separating nondisintegrated material;

wherein said screen member comprises a plurality of stationary surfaces and a plurality of moving surfaces in operative proximity with said stationary surfaces and forming a plurality of screening slots therewith.

10. Apparatus as claimed in claim 9, further comprising discs mounted on said defiberizing rotor and providing said moving surfaces and stationary rings providing said stationary surfaces, said discs rotating between adjacent ones of said rings.

* * * * *